United States Patent [19]

Kersten et al.

[11] 3,961,562

[45] June 8, 1976

[54] MULTIPLE PUMP ASSEMBLY

[75] Inventors: Günter Kersten; Ulrich Aldinger; Emil Knodel; Rainer Knoblauch, all of Stuttgart, Germany

[73] Assignee: Robert Bosch GmbH, Stuttgart, Germany

[22] Filed: Dec. 26, 1973

[21] Appl. No.: 428,613

[30] Foreign Application Priority Data

Jan. 12, 1973 Germany ..... 2301448

[52] U.S. Cl. ..... 91/492

[51] Int. Cl.[2] ..... F01B 13/06

[58] Field of Search ..... 91/485, 472, 492, 497, 91/498, 501

[56] References Cited

UNITED STATES PATENTS

| | | | |
|---|---|---|---|
| 1,243,494 | 10/1917 | Dunning | 91/498 |
| 2,186,556 | 1/1940 | Robbins | 91/497 |
| 2,208,568 | 7/1940 | Benedek | 91/492 |
| 2,254,103 | 8/1941 | Douglas | 91/474 |
| 2,465,510 | 3/1949 | Bonnafe | 91/503 |
| 2,484,337 | 10/1949 | Ferris | 91/485 |
| 2,562,363 | 7/1951 | Nixon | 91/501 |
| 2,585,574 | 2/1952 | Muller | 91/492 |
| 2,815,718 | 12/1957 | Avery | 91/498 |
| 2,972,962 | 2/1961 | Douglas | 91/485 |
| 3,306,209 | 2/1967 | Tyler | 91/472 |
| 3,398,698 | 8/1968 | Eickmann | 91/485 |

*Primary Examiner*—William L. Freeh
*Attorney, Agent, or Firm*—Michael J. Striker

[57] ABSTRACT

A multiple pump assembly consisting of a series of two or more coaxial pumps the first of which is invariably a radial piston pump. The shaft of the prime mover drives the first pump by way of an Oldham coupling and an extension of this shaft extends through an axial bore of the pintle in the first pump to drive the rotary element of the second pump as well as any further pump of the assembly. If the second pump is also a radial piston pump, the two pumps may but need not have a common pintle. The slide block of each radial piston pump can be adjusted to change the rate of delivery of pressurized fluid. The fluid admitting and evacuating channels in the pintle or pintles may be formed by an electrochemical process, or the entire pintle may constitute a casting. The housing for the multiple pump assembly may include a discrete annular section for each pump or a single annular section for all of the pumps and cover members at the axial ends of the single section.

18 Claims, 9 Drawing Figures

MULTIPLE PUMP ASSEMBLY

BACKGROUND OF THE INVENTION

The present invention relates to multiple pump assemblies (also called multiple pumps) in general, and more particularly to improvements in multiple pump assemblies which consist exclusively of or include at least one radial piston pump.

It is already known to assemble a multiple pump assembly of as many as four discrete coaxial radial piston pumps and to provide for all of the pumps a common prime mover having an output shaft which carries eccentrics serving to reciprocate the pistons of the radial piston pumps. A drawback of such multiple pump assemblies is that they must employ a large-diameter output shaft which should be capable of withstanding substantial torsional stresses and which, to this end, must be mounted in heavy-duty bearings between each pair of neighboring pumps. This contributes excessively to the dimensions (especially axial length), weight, bulk and initial and maintenance cost of the multiple pump assembly.

SUMMARY OF THE INVENTION

An object of the invention is to provide a multiple pump assembly which is more compact, simpler, less expensive but just as effective and versatile as presently known multiple pump assemblies.

Another object of the invention is to provide a multiple pump assembly with novel and improved means for conveying fluid to and from discrete pumps.

A further object of the invention it to provide a multiple pump assembly wherein two or more identical or different types of pumps ca be assembled into a compact, relatively short and rugged aggregate.

An additional object of the invention is to provide a multiple pump assembly wherein the mounting of the output member of the prime mover is simpler and the output member is also simpler than the mountings for and the output members of prime movers in conventional multiple pump assemblies.

Still another object of the invention is to provide one or more novel pintles for the radial piston pump or pumps of the improved multiple pump assembly.

A further object of the invention is to provide a novel method of making the pintle or pintles for the radial piston pump or pumps of the improved multiple pump assembly.

The invention is embodied in a multiple pump assembly which comprises a series of pumps having coaxial drive shaft means constituting the output member or members of a suitable prime mover. The pump assembly includes a first or foremost pump which is nearest to the prime mover and at least one additional pump which is coaxial with the first pump. At least the first pump constitutes a radial piston pump having a cylindrical pintle or valve which is coaxial with the shaft means and is formed with channel means for admission and/or evacuation of fluid from the first pump, a cylinder block which surrounds the pintle and is driven by the shaft means (preferably through the medium of an Oldham coupling) and has radially extending cylinders for fluid displacing and pressurizing pistons, and a slide block surrounding the pistons and being normally eccentric to the cylinder block so as to effect reciprocatory movements of pistons when the cylinder block is rotated by the shaft means.

In accordance with a feature of the invention, the pintle of the first pump has an axial bore for a portion of the shaft means whereby such portion of the shaft means extends toward or into the additional pump to drive one or more rotary elements of the additional pump.

The additional pump may constitute a gear pump or a second rotary piston pump whose pintle may but need not be integral with the pintle of the first pump.

The housing of the multiple pump assembly may include discrete sections for each pump and an intermediate section disposed between such discrete sections and secured thereto by means of bolts or analogous fasteners. The aforementioned portion of the shaft means may be mounted in bearings provided therefor in the intermediate section. It is also within the purview of the invention to provide a common housing for the entire series of discrete pumps.

The novel features which are considered as characteristic of the invention are set forth in particular in the appended claims. The improved multiple pump assembly itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
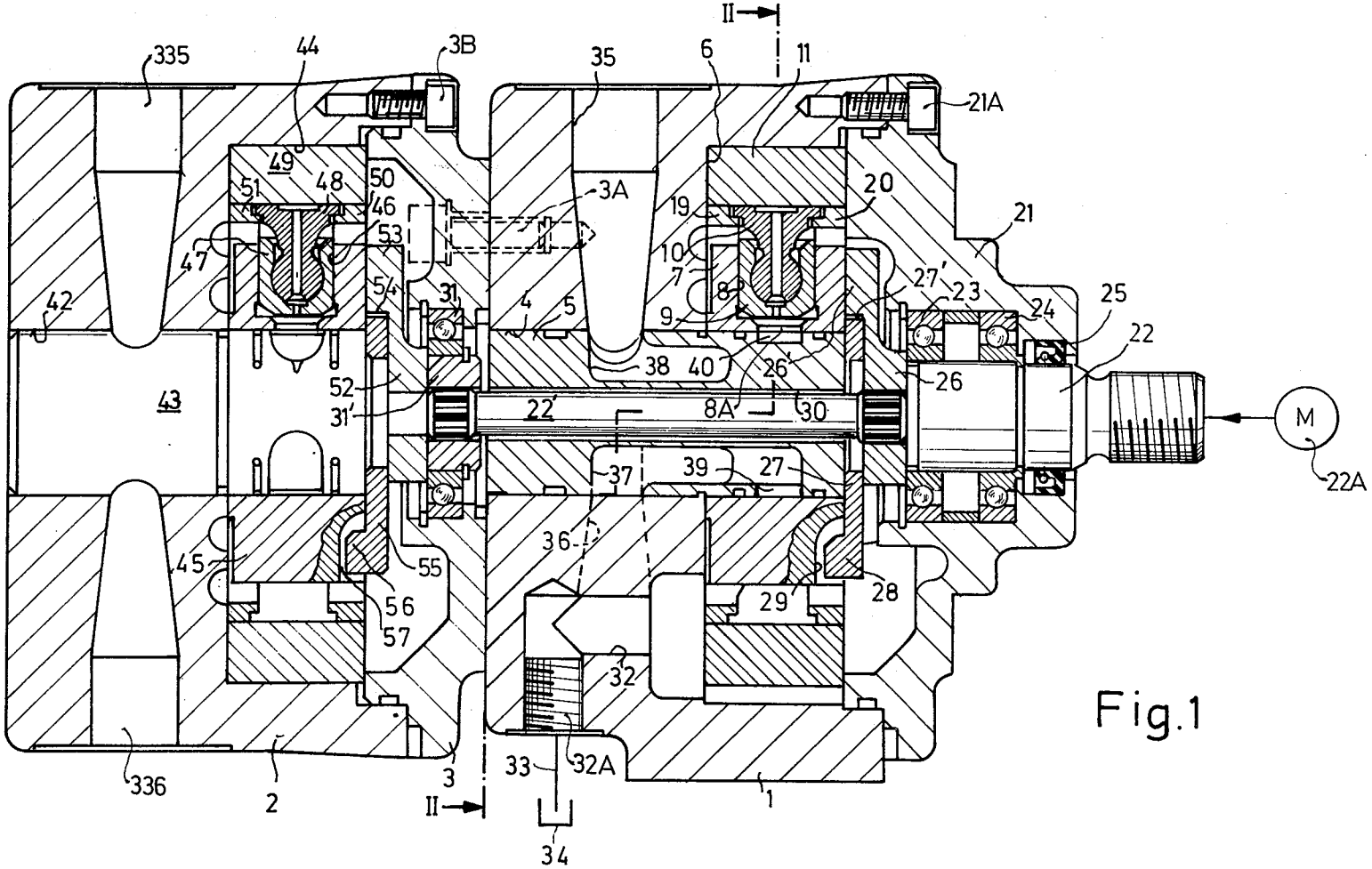
FIG. 1 is an axial sectional view of a double pump assembly which consists of two radial piston pumps.

FIG. 1 shows a double radial piston pump assembly having a housing including two annular main sections 1, 2 and an intermediate or coupling section 3 secured to the main sections 1, 2 by bolts 3A, 3B or analogous fasteners. The main section 1 constitutes the body of a first or foremost radial piston pump and is formed with an axial bore 4 having portions of different diameters. The bore 4 receives a fixedly mounted valve or pintle 5 of the first radial piston pump, and this pintle is surrounded by a cylinder block 7 which is rotatable in an enlarged portion 6 of the bore 4. The cylinder block 7 is formed with equidistant radially extending cylinders 8 for pistons 9 having at their outer ends suitable shoes or followers 10 serving to travel along the cylindrical internal surface of a radially movable slide block 11. In a manner well known from the art of radial piston pumps, the eccentricity of the slide block 11 with respect to the common axis of the pintle 5 and the cylinder block 7 determines the length of strokes which the pistons 9 perform when the cylinder block is caused to rotate about the pintle.

Figure 2:
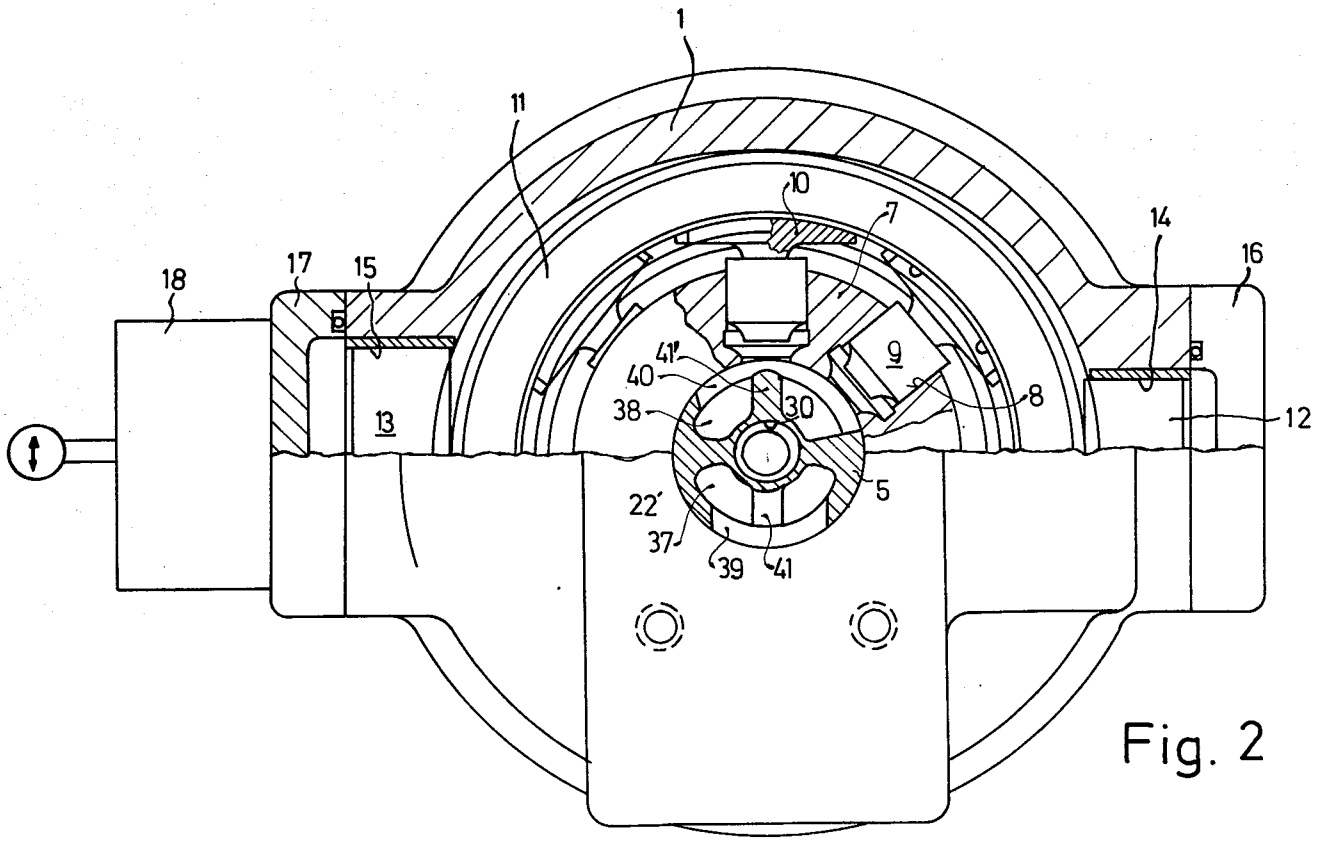
FIG. 2 is a sectional view as seen in the direction of arrows from the line II—II of FIG. 1.

FIG. 2 illustrates one form of adjusting means for changing the eccentricity of the slide block 11 with respect to the cylinder block 7. The main section 1 is formed with two cylinder chambers 14, 15 which are located diametrically opposite each other with respect to the axis of the cylinder block 7 and respectively receive pistons 12 and 13. The outer ends of the cylinder chambers 14, 15 are respectively sealed by cover members or caps 16, 17. The axial positions of the pistons 12, 13 in the respective cylinder chambers 14, 15 determine the eccentricity of the slide block 11. The aggregate which can be actuated to change the axial positions of pistons 12, 13 by controlling the flow of a hydraulic or pneumatic fluid into and from the cylinder chambers 14, 15 is shown at 18; the details of this aggregate form no part of the present invention.

FIG. 1 further shows two-ring-shaped retainers 19, 20 which are secured to the slide block 11 and have inwardly extending portions which overlie parts of the shoes 10 to thus insure that the convex external surfaces of the shoes remain in contact with the internal surface of the slide block.

The right-hand end of the bore 4, as viewed in FIG. 1, is closed by a cover member 21 which is secured to the main section 1 by bolts 21A or analogous fasteners. The cover member 21 cooperates with an internal shoulder of the main section 1 to hold the slide block 11 against excessive axial movement. The prime mover 22A which rotates the cylinder block 7 has an output shaft or drive shaft 22 which is rotatable in antifriction bearings 23, 24 provided therefor in the cover member 21 and has a disk-shaped flange 26 having two aligned radial projections or claws 26' extending into complementary aligned radial recesses or sockets 27' of a second disk 27. The latter has two aligned radially extending projections or claws 28 extending into complementary radial sockets or recesses 29 of the cylinder block 7. The plane of the projections 26' is normal to the plane of projections 28. An annular shaft seal 25 is installed in the right-hand portion of the cover member 21 to seal the bore 4 from the atmosphere. The coupling including the parts 26–29 is a so-called Oldham coupling which permits for some misalignment of the driven and driving parts.

The output shaft 22 of the prime mover 22A for the rotary piston pump in the main section 1 has a smaller-diameter portion or extension 22' which is rotatable in an axial bore 30 of the pintle 5 and serves to transmit torque to the cylinder block 45 of a second or additional radial piston pump mounted in the main section 2. That part of the shaft extension 22' which passes through the intermediate section 3 has splines to take an internally splined ring 31' rotatable in an antifriction bearing 31 in the section 3.

The main section 1 is further formed with a channel 32 communicating with a port 32A which is connected with a reservoir or tank 34 by a conduit 33. Still further, the main section 1 has radially extending channels 35, 36 one of which admits unpressurized fluid to the first pump and the other of which conveys pressurized fluid to a consumer, not shown, or vice versa. The channels 35, 36 respectively communicate with axially parallel kidney-shaped channels 38, 37 in the pintle 5, and the channels 37, 38 respectively communicate with elongated control chambers 39, 40 machined into the periphery of the pintle 5 in register with the ports 8A at the inner ends of cylinders 8 in the cylinder block 7. When the cylinder block 7 rotates, successive ports 8A laternately communicate with the control chambers 39 and 40.

Figure 4:
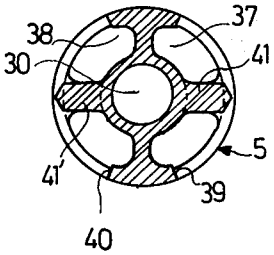
FIG. 4 is a sectional view as seen in the direction of arrows from the line IV—IV of FIG. 3.
Figure 5:
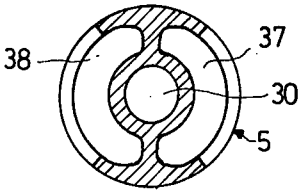
FIG. 5 is a sectional view as seen in the direction of arrows from the line V—V of FIG. 3.
Figure 3:
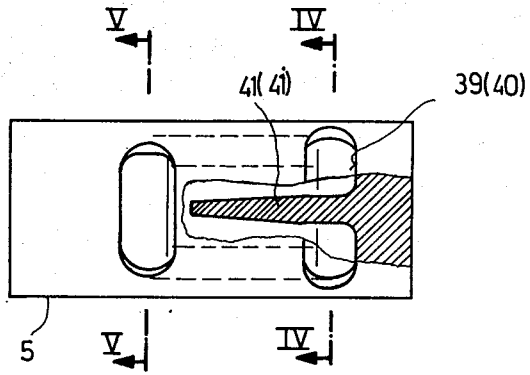
FIG. 3 is an elevational view of the pintle in the first radial piston pump of the double pump assembly shown in FIG. 1, with a portion of the pintle broken away.

The details of the pintle 5 are shown in FIGS. 3 to 5. An internal reinforcing or stiffening rib 41, 41' of the pintle 5 halves portions of the kidney-shaped channels 37, 38; this rib further extends across the entire control chambers 39, 40, (as considered in the axial direction of the pintle) in a manner best shown in FIG. 4.

The main housing section 2 constitutes the body of the second or additional radial piston pump which includes the aforementioned cylinder block 45 (see FIG. 1). The latter is rotatable in an enlarged portion 44 of an axial bore 42 which is coaxial with the bore 4 of the main section 1 and receives a fixedly mounted valve or pintle 43. The radial cylinders 46 of the cylinder block 45 receive reciprocable pistons 47 having shoes 48 which engage the internal surface of a second radially adjustable slide block 49. The adjusting means (not shown) for changing the eccentricity of the slide block 49 with respect to the common axis of the pintle 43 and the cylinder block 45 is preferably identical with or analogous to the adjusting means shown in FIG. 2. The slide block 49 carries two retaining rings 50, 51 corresponding to the retaining rings 19, 20 and serving to hold the shoes 48 against movement radially inwardly of the internal surface of the slide block 49.

The pintle 43 is practically identical with the pintle 5 except that it need not be formed with an axial bore corresponding to the bore 30 of the pintle 5. Also, the arrangement of channels 335, 336 in the main section 2 is preferably identical or analogous to the arrangement of channels 35, 36 in the main section 1.

That portion of the extension 22' of the output shaft 22 which extends beyond the ring 31' in the intermediate section 3 is formed with a disk-shaped flange 52 having two aligned radial projections or claws 53 extending into aligned radially extending complementary sockets or recesses 54 of a second disk 55. The latter has two aligned radially extending projections or claws 56 extending into complementary radial recesses or sockets 57 of the cylinder block 45. The parts 52–57 constitutes a second Oldham coupling which transmits torque from the extension 22' to the cylinder block 45 when the prime mover 22A drives the output shaft 22.

The intermediate section 3 cooperates with an internal shoulder of the main section 2 to hold the slide block 49 against excessive axial movement.

An important advantage of the double pump assembly of FIGS. 1 to 5 is that the means (extension 22') for rotating the cylinder block 45 of the second or additional radial piston pump extends through the axial bore 30 of the pintle 5 of the first or foremost radial piston pump. This contributes to compactness of the double pump assembly without interfering with individual adjustments of eccentricities of the two slide blocks 11 and 49. Thus, the output of the first and/or second radial piston pump can be changed without resorting to complex distributor gears. The provision of channels 37, 38 in the pintle 5 of the first pump does not interfere with the machining of axial bore 30 for the extension 22' because the channels 37, 38 are kidney-shaped cavities. The aforementioned rib 41, 41' enhances the rigidity of the pintle 5 in spite of the fact that this pintle is formed with relatively large channels 37, 38. Such configuration of the pintle 5 is particularly desirable when the latter is produced by resorting to a precision casting process.

Another advantage of the pump assembly of FIGS. 1 to 5 is that the control element of the first or foremost pump in can main housing section 1 is a pintle or valve 5, i.e., that the first pump is a radial piston pump. This allows for highly satisfactory admission of fluid to and for equally satisfactory evacuation of pressurized fluid from the first pump. Also, the rotary elements of all pumps can be driven at any desired practical speed without resorting to overdimensioned drive shaft means.

If desired, the channels and/or control chambers in the pintles of the two radial piston pumps shown in FIG. 1 can be formed by resorting to a suitable electrochemical process.

Figure 6:
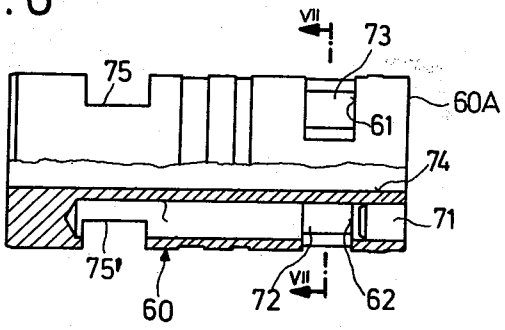
FIG. 6 is a partly elevational and partly axial sectional view of a pintle which can be used as a substitute for the pintle of FIGS. 3 to 5.
Figure 7:
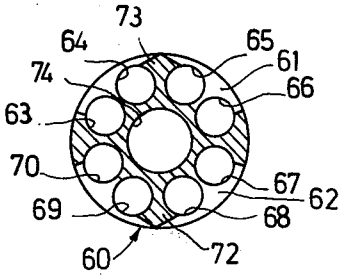
FIG. 7 is a sectional view as seen in the direction of arrows from the line VII—VII of FIG. 6.

FIGS. 6 and 7 illustrate a modified pintle 60 for the first pump of a multiple pump assembly. The periphery of the pintle 60 is formed with two elongated circumferentially extending control chambers 61, 62 which are located diametrically opposite each other and correspond substantially to the control chambers 39, 40 of FIG. 1. These chambers register alternately with ports at the inner ends of cylinders in a cylinder block (not shown) corresponding to the cylinder block 7 of FIG. 1 when the cylinder block is driven by the output shaft of a suitable prime mover. The pintle 60 is further formed with eight axially parallel bores or channels 63, 64, 65, 66, 67, 68, 69 and 70 whose axes are equidistant from each other and are located at the same distance from the axis of the pintle. Portions of the bores 63–66 communicate with the control chamber 61, and portions of the bores 67–70 communicate with the control chamber 62. The bores 63–70 are blind bores, i.e., each thereof extends all the way to the righthand end face 60A of the pintle 60, as viewed in FIG. 6, and the inner ends of the bores 63–66 and 67–70 respectively communicate with two circumferentially extending grooves 75, 75' machined into the periphery of the pintle 60. The grooves 75, 75' respectively commuicate with channels corresponding to the channels 35, 36 in the main housing section 1 of FIG. 1. The open ends of the bores 63–70 are sealed by plugs 71 or analogous sealing elements. The pintle 60 is further formed with two reinforcing ribs 73, 72 which are respectively disposed between the bores 64, 65 of the first set and the bores 68, 69 of the second set of blind bores. It will be noted that the reinforcing ribs 72, 73 are located diametrically opposite each other with respect to the axis of the pintle 60 and respectively extend axially across the control chambers 62, 61. The pintle 60 is further formed with an axial bore 74 for the extension of the output member which drives the cylinder block of the second pump in the assembly whose first pump includes the pintle 60. The bore 74 corresponds to the bore 30 of the pintle 5 shown in FIG. 1.

The advantages of the pintle 60 are analogous to those of the pintle 5. Thus, the two sets of bores 63, 66 and 67–70 together constitute two axially parallel channels of relatively large volume for the flow of fluid between the control chambers 61, 62 and the corresponding channels in the body of the first pump. Also, the ribs 72, 73 reinforce the pintle 60 in the region of bores 63–70 and control chambers 61, 62, and the bores 63–70 are distributed in such a way that they allow for the making of a relatively large axial bore 74 for the extension of the output shaft. It has been found that the ribs 41, 41' or 72, 73 contribute significantly to rigidity of the pintle 5 or 60. The pintle 60 of FIGS. 6 and 7 is particularly suited for use in multiple pump assemblies which are produced in small series so that it is economically feasible to make the bores 63–70 and 74 by resorting to a material removing procedure rather than to casting.

Figure 8:
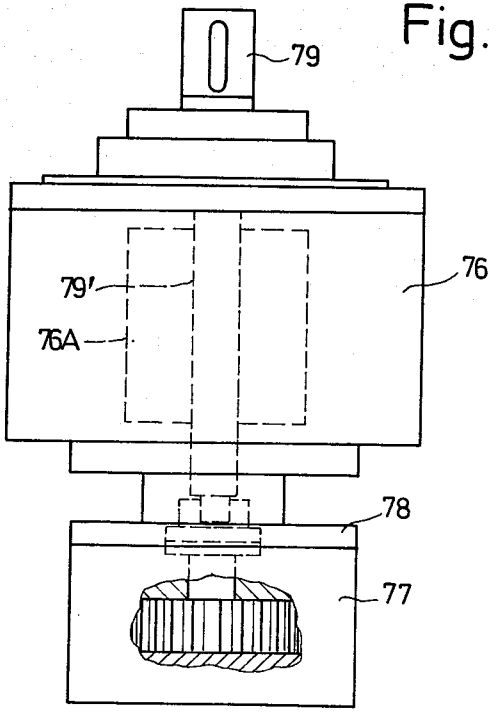
FIG. 8 is a schematic elevational view of a second double pump assembly wherein only the first pump is a radial piston pump.

The double pump assembly of FIG. 8 comprises two pumps 76, 77. The pump 76 is a radial piston pump and the pump 77 is a gear pump whose housing is coupled to the housing of the pump 76 by an intermediate section of flange 78. The output shaft 79 of the prime mover has an extension 79' extending through the axial bore of the pintle 76A of the radial piston pump 76 in a manner similar to that shown in FIG. 1. The extension 79' drives one or more rotary elements of the gear pump 77. It is clear that the second pump 77 may constitute another type of pump, for example, an axial piston pump, a vane pump or any other pump which can be driven by the extension 79'. This is made possible because the construction of the first pump as a radial piston pump permits for introduction of a portion 79' of the output shaft 79 of the prime mover through the pintle 76A of the first pump 76 without resorting to complex distributor gearings which are needed in presently known multiple pump assemblies. Another advantage of the improved multiple pump assembly wherein the first pump is a radial piston pump with a pintle of the type shown in FIGS. 1–5, 6–7 or 8 is that at least one of the pumps (for example, at least the first pump) is adjustable to vary its delivery within a desired range.

The second or additional pump 77 can be used as a charging or compression pump.

Figure 9:
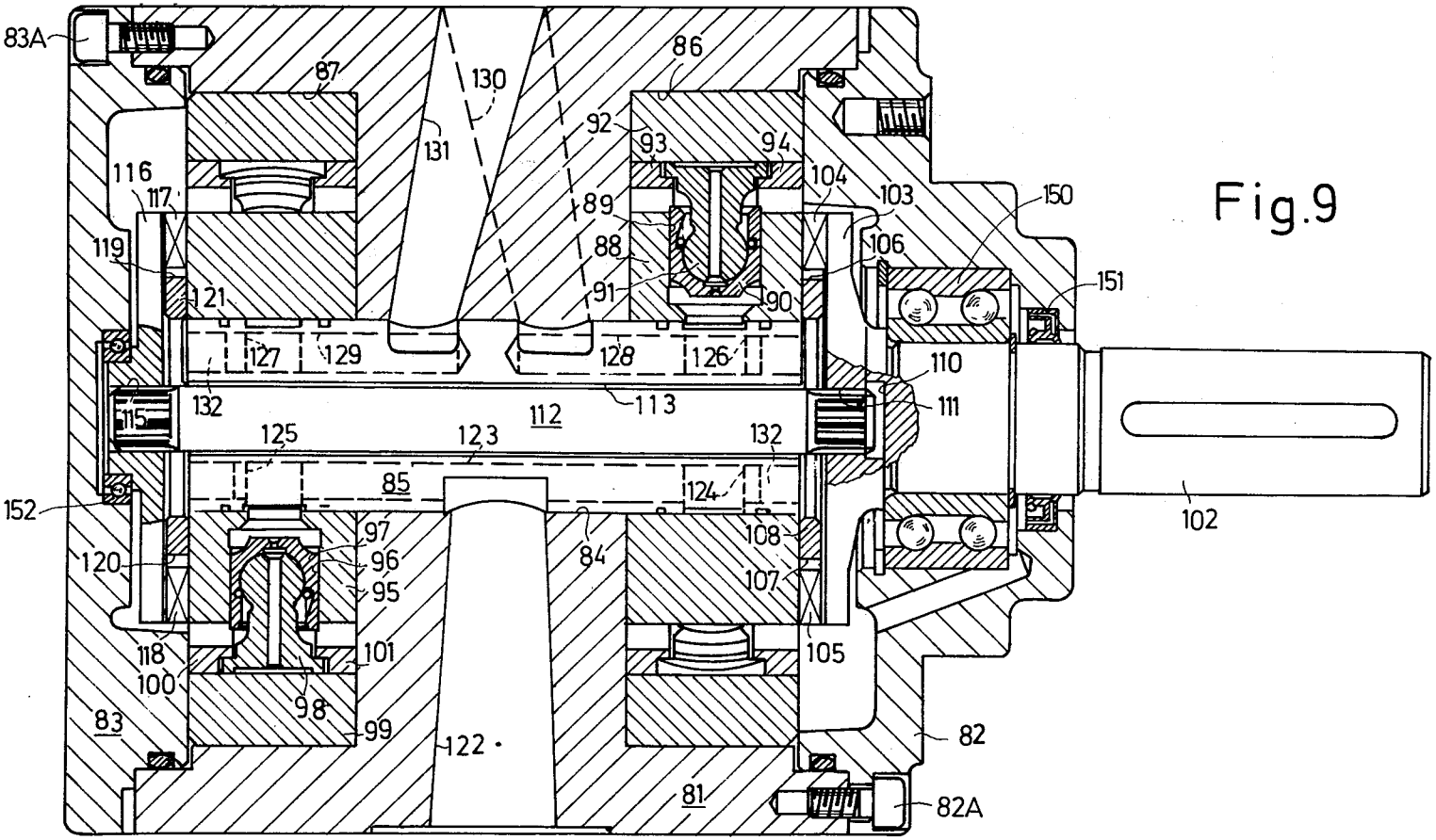
FIG. 9 is an axial sectional view of a third double pump assembly with two radial piston pumps having a common pintle.

FIG. 9 illustrates a further multiple pump assembly wherein the two radial piston pumps comprise a common housing or body 81. The ends of the body 81 are closed and sealed by cover members 82, 83 which are secured thereto by bolts 82A, 83A or analogous fastener means. The housing 81 is formed with an axially extending bore 84 having portions of different diameters. The main portion of the bore 84 receives an elongated cylindrical valve or pintle 85 which is held against rotation in the housing 81 and comprises end portions extending into enlarged end portions 86, 87 of the bore 84. The enlarged portion 86 further receives a cylinder block 88 which is rotatable on the adjacent portion of the pintle 85 and has radial cylinders 89 for pistons 90. The shoes 91 of the pistons 90 abut against the internal surface of a radially movable slide block 92. Two retaining rings 93, 94 are provided to hold the shoes 91 against movement radially inwardly and away from the internal surface of the slide block 92.

The second enlarged end portion 87 of the bore 84 receives a second cylinder block 95 which is rotatable on the adjacent portion of the pintle 85 and has radially extending cylinders 96 for pistons 97 having shoes 98 which are slidably coupled to a second slide block 99 by two retaining rings 100, 101. The means for adjusting the slide blocks 92, 99 relative to the respective cylinder blocks 88, 95 preferably correspond to the adjusting means shown in FIG. 2.

The output shaft 102 of a prime mover (not shown) is rotatable in a twin antifriction bearing 150 installed in the cover member 82 and is surrounded by a shaft seal 151. A disk-shaped flange 103 of the output shaft 102 has two aligned radial claws or projections 104, 105 extending into complementary radial sockets 106, 107 of a second disk 108. The latter has two additional aligned radial sockets (not shown because extending at right angles to the plane of FIG. 9) for radial projections on the cylinder block 88. The second pair of sockets in the left-hand end face of the disk 108 makes an angle of 90° with the sockets 106, 107. Thus, the coupling between the output shaft 102 and the cylinder block 88 is a typical Oldham coupling which allows for at least some misalignment between the driving (102), driven (88) and intermediate (108) parts.

The flange 103 of the output shaft 102 is formed with an axially extending blind bore 110 communicating with axially parallel grooves 111 for axially parallel external teeth of an elongated shaft 112 rotatable in an axial bore 113 of the pintle 85. The other end of the shaft 112 is formed with similar axially parallel teeth 115 extending into axially parallel grooves which communicate with an axial bore of a second disk-shaped flange 116 at the left-hand side of the cylinder block 95. The flange 116 has a pair of aligned radially extending projections or claws 117, 118 extending into complementary sockets or recesses 119, 120 of a disk 121 which is provided with a second pair of sockets (extending at right angles to the sockets 119, 120 and to the plane of FIG. 9) for two projections or claws of the cylinder block 95.

The housing 81 is formed with a channel 122 for admission of fluid, and the channel 122 communicates with a channel 123 in the pintle 85. The ends of the channel 123 communicate with two control chambers 124, 125 which respectively register with the ports at the inner ends of successive cylinders 89 and 96 when the cylinder blocks 88, 95 rotate about the pintle 85. The control chambers 124, 125 are respectively located diametrically opposite control chambers 126, 127 and respectively communicate with axially parallel channels 128, 129 of the pintle 85. The channels 128, 129 respectively communicate with channels 130, 131 in the housing 81 of the double pump assembly. The channels 130, 131 serve for evacuation of pressurized fluid. Plugs 132 or analogous sealing elements seal the ends of the channel 123 in the pintle 85 from the interior of the housing 81. Similar plugs 132 are provided to seal the outer ends of the channels 128, 129 in the pintle 85. The channels 123, 128, 129 serve the same purpose as the corresponding channels shown in FIGS. 1–5 or 6–7.

The double pump assembly of FIG. 9 also exhibits the advantage that the second pump (including the cylinder block 95) can be driven by an extension 112 of the output shaft 102 of the prime mover for the first pump (including the cylinder block 88). Thus, here again, the means for transmitting torque to the rotary element of the second pump need not embody a complex distributor gearing or the like. The pump assembly of FIG. 9 further exhibits the advantage that its axial length is extremely small due to the fact that the two pumps in the housing 81 employ a common pintle 85. Another advantage of the double pump assembly of FIG. 9 is that each of its radial piston pumps can be assembled almost entirely of identical component parts which contributes to a reduction of the initial cost and renders it possible to properly service both pumps while maintaining a relatively small store of spare parts. In each embodiment of the present invention wherein the multiple pump assembly employs two or more radial piston pumps, the cylinder blocks of the radial piston pumps are preferably installed in such a way that the cylinders (e.g., 89) of one cylinder block (88) are angularly offset relative to the cylinders (96) of the other cylinder block (95) to thus insure that the double pump assembly can operate with a minimum of pulsation. The arrangement is preferably such that, if the number of cylinders in one cylinder block equals the number of cylinders in the other cylinder block, the cylinders of one block are located exactly midway between the neighboring cylinders of the other block, as considered in the axial direction of the radial piston pumps, especially if the two radial piston pumps supply pressurized fluid to a common consumer. It is further to be noted that the composite drive shaft or output shaft 102, 112 can be replaced with a one-piece shaft; however, the assembling of this drive shaft from two portions is preferred at this time because this simplifies the making and finishing of such parts. The flange 116 at the left-hand end of the shaft 112 rotates in an antifriction bearing 152 of the cover member 83.

It is further possible to construct the pump assembly of FIG. 9 as a triple, quadruple, etc., pump assembly. For example, the cover member 83 can perform the function of the intermediate section 3 of the double pump assembly shown in FIG. 1, and the multiple pump assembly of FIG. 9 is then ready to be provided with a third radial piston pump or with another type of pump which is driven by the shaft 112 or by an extension of this shaft in the same or similar way as shown for the shafts 22, 22′ of FIG. 1.

Without further analysis, the foregoing will so fully reveal the gist of the present invention that others can by applying current knowledge readily adapt it for various applications without omitting features which fairly constitute essential characteristics of the generic or specific aspects of our contribution to the art and, therefore, such adaptations should and are intended to be comprehended within the meaning and range of equivalence of the claims.

What is claimed as new and desired to be protected by Letters Patent is set forth in the appended claims:

1. A multiple pump assembly comprising a series of pumps having coaxial drive shaft means and including a first pump and at least one additional pump, said first pump constituting a radial piston pump and including a pintle coaxial with said shaft means, a cylinder block driven by said shaft means, rotatably surrounding said pintle and having radial cylinders, fluid displacing and pressurizing pistons in said cylinders, and a slide block surrounding said pistons and being eccentric with respect to said cylinder block so as to effect reciprocatory movements of said pistons in response to rotation of said cylinder block, said pintle having channel means for evacuation of fluid which is pressurized by said pistons and an axial bore for a portion of said shaft means, said additional pump having a rotary element driven by said portion of said shaft means; and first and second coupling means for respectively transmitting torque from said shaft means to said cylinder block and said rotary element.

2. A multiple pump assembly as defined in claim 1, further comprising a housing including discrete first and second sections respectively surrounding said first pump and said additional pump, and a third section disposed between and connected to said first and second sections.

3. A multiple pump assembly as defined in claim 1, wherein at least one of said couplings is an Oldham coupling.

4. A multiple pump assembly as defined in claim 1, further comprising a housing for said pumps, said housing having first and second channels one of which receives pressurized fluid from the channel means of said pintle and the other of which admits fluid to said first pump, and third and fourth channels respectively arranged to admit fluid to and to evacuate pressurized fluid from said additional pump.

5. A multiple pump assembly as defined in claim 1, at least said first coupling means including a flange provided on said shaft means, a disk between said flange and said cylinder block, a first radial projection provided on said flange and extending into a radial socket of said disk, and a second radial projection provided on said disk and extending into a radial socket of said cylinder block, said second projection being normal to said first projection.

6. A multiple pump assembly as defined in claim 1, wherein said additional pump constitutes a second radial piston pump having a second pintle coaxial with said first mentioned pintle and a cylinder block surrounding said second pintle and constituting said rotary element.

7. A multiple pump assembly as defined in claim 6, further comprising a housing having first and second sections respectively surrounding said first and second radial piston pumps and an intermediate section disposed between and connected to said first and second sections, said portion of said shaft means being rotatable in bearing means provided therefor in said intermediate section.

8. A multiple pump assembly as defined in claim 1, wherein said pintle has second channel means for admission of fluid to said cylinders and each of said channel means has a kidney-shaped cross-sectional outline.

9. A multiple pump assembly as defined in claim 8, wherein said pintle has two circumferentially extending control chambers communicating alternately with successive cylinders of said cylinder block; each of said chambers communicating with a different one of said channel means and said pintle further having two reinforcing ribs extending axially of the pintle across said chambers and each having at least a portion of the respective channel means.

10. A multiple pump assembly as defined in claim 9, wherein each of said channel means extends substantially axially of said pintle.

11. A multiple pump assembly as defined in claim 1, wherein said pintle has second channel means for admission of fluid to said first pump and each of said channel means includes at least two communicating axially parallel bores provided in said pintle.

12. A multiple pump assembly as defined in claim 11, wherein the axes of all of said last mentioned bores are located at the same distance from the axis of said pintle.

13. A multiple pump assembly comprising a series of pumps having coaxial drive shaft means and including a first pump and at least one additional pump, said first pump constituting a radial piston pump and including a stationary pintle coaxial with said shaft means, a cylinder block driven by said shaft means, rotatably surrounding said pintle and having radial cylinders, fluid displacing and pressurizing pistons in said cylinders, and a slide block surrounding said pistons and being eccentric with respect to said cylinder block so as to effect reciprocatory movements of said pistons in response to rotation of said cylinder block, said pintle having channel means for evacuation of fluid which is pressurized by said pistons and an axial bore for a portion of said shaft means, said additional pump having a rotary element driven by said portion of said shaft means, said shaft means comprising a discrete second portion which drives said cylinder block and said first mentioned portion of said shaft means receiving torque from said second portion.

14. A multiple pump assembly as defined in claim 13, wherein said additional pump constitutes a second radial piston pump and said pintle is common to said first and second radial piston pumps, said channel means including discrete first and second channels for evacuation of pressurized fluid from said first and second pumps and said pintle further having a third channel for admission of fluid to said first and second pumps.

15. A multiple pump assembly as defined in claim 13, wherein said additional pump constitutes a second radial piston pump including a cylinder block constituting said rotary element driven by said portion of said shaft means.

16. A multiple pump assembly as defined in claim 13, wherein said series of pumps consists of two radial piston pumps and said pintle is common to said radial piston pumps.

17. A multiple pump assembly as defined in claim 16, further comprising a common housing for said radial piston pumps.

18. A multiple pump assembly as defined in claim 17, wherein said housing includes an annular main section and cover members at the ends of said main section, said shaft means extending through one of said cover members, through said bore of said pintle, and to the other of said cover members, said rotary element constituting the cylinder block of the other of said radial piston pumps and being adjacent to said other cover member, and further comprising anti-friction bearing means provided for said shaft means in each of said cover members.

* * * * *